US010482808B2

(12) United States Patent
Yang et al.

(10) Patent No.: US 10,482,808 B2
(45) Date of Patent: Nov. 19, 2019

(54) PIXEL CONTROL CIRCUIT AND CONTROL METHOD THEREOF, DISPLAY DEVICE

(71) Applicants: BOE TECHNOLOGY GROUP CO., LTD., Beijing (CN); BEIJING BOE DISPLAY TECHNOLOGY CO., LTD., Beijing (CN)

(72) Inventors: Weifan Yang, Beijing (CN); Na Li, Beijing (CN)

(73) Assignees: BOE TECHNOLOGY GROUP CO., LTD., Beijing (CN); BEIJING BOE DISPLAY TECHNOLOGY CO., LTD., Beijing (CN)

( * ) Notice: Subject to any disclaimer, the term of this patent is extended or adjusted under 35 U.S.C. 154(b) by 0 days.

(21) Appl. No.: 15/995,629

(22) Filed: Jun. 1, 2018

(65) Prior Publication Data

US 2019/0122602 A1 Apr. 25, 2019

(30) Foreign Application Priority Data

Oct. 19, 2017 (CN) ..... 2017 1 0979271

(51) Int. Cl.
*G09G 3/22* (2006.01)

(52) U.S. Cl.
CPC ..... *G09G 3/22* (2013.01); *G09G 2300/08* (2013.01); *G09G 2310/0256* (2013.01); *G09G 2320/0276* (2013.01)

(58) Field of Classification Search
CPC ..... G09G 3/22; G09G 2320/0276; G09G 2300/08; G09G 2310/0256
See application file for complete search history.

(56) References Cited

U.S. PATENT DOCUMENTS 9,075,382 B2 7/2015 Nakamura et al.
2010/0097360 A1* 4/2010 Cho ..... G09G 3/325 345/205

(Continued)

FOREIGN PATENT DOCUMENTS

CN 103050098 A 4/2013
CN 104238209 A 12/2014

(Continued)

OTHER PUBLICATIONS

Chinese Office Action in corresponding Chinese Application No. 201710979271.X dated Aug. 20, 2019 (an English ranslation attached hereto). 15 pages.

*Primary Examiner* — Christopher J Kohlman
(74) *Attorney, Agent, or Firm* — Leason Ellis LLP

(57) ABSTRACT

A pixel control circuit and a control method thereof, and a display device. The pixel control circuit includes a control-signal output sub-circuit and a switch sub-circuit. An input terminal of the switch sub-circuit is electrically coupled to an output terminal of the control-signal output sub-circuit. An input terminal of the control-signal output sub-circuit is electrically coupled to a data line. The control-signal output sub-circuit is configured to: compare a voltage received by the data line with a reference voltage; and if a value of the voltage is equal to a value of the reference voltage, output a first control signal, otherwise output a second control signal. The switch sub-circuit is configured to be turned off under control of the first control signal and turned on under control of the second control signal. The reference voltage is a corresponding gamma voltage when the display panel is in a dark state.

20 Claims, 4 Drawing Sheets

(56) References Cited

U.S. PATENT DOCUMENTS

| | | | |
|---|---|---|---|
| 2013/0093797 | A1 | 4/2013 | Guo |
| 2013/0208199 | A1 | 8/2013 | Sakamoto et al. |
| 2016/0125825 | A1 | 5/2016 | Yao |
| 2016/0307509 | A1 | 10/2016 | Nie |

FOREIGN PATENT DOCUMENTS

| | | | |
|---|---|---|---|
| CN | 104238329 | A | 12/2014 |
| CN | 104575395 | A | 4/2015 |
| CN | 106652869 | A | 5/2017 |

* cited by examiner

PIXEL CONTROL CIRCUIT AND CONTROL METHOD THEREOF, DISPLAY DEVICE

The disclosure claims the priority of the Chinese Patent Application No. 201710979217.X filed on Oct. 19, 2017, which is incorporated herein by reference in its entirety as part of the disclosure of the present application.

TECHNICAL FIELD

Embodiments of the present disclosure relate to a pixel control circuit, a control method of the pixel control circuit and a display device.

BACKGROUND

Thin Film Transistor-Liquid Crystal Display (TFT-LCD) devices are a type of flat panel display devices, which have been increasingly and widely used due to advantages such as a small size, low radiation, and low power consumption and so on.

With continuous development of liquid crystal display devices, requirements on image quality of a display panel are higher and higher. Currently, a fabricated display panel has a problem of light leakage in a dark state, and the light leakage in the dark state affects the image quality of the display panel.

The light leakage in the dark state of the display panel is generally divided into a mechanical light leakage and a pixel light leakage. In order to reduce the light leakage in the dark state, at present the mechanical light leakage is generally reduced by adjusting a mechanical film material or structure; but currently there is no good way to reduce the pixel light leakage.

Existing display panels have a problem of light leakage in the dark state, and the image quality of the display panels is poor.

SUMMARY

Embodiments of the disclosure provide a pixel control circuit, comprising: a control-signal output sub-circuit and a switch sub-circuit; wherein:

an input terminal of the switch sub-circuit is electrically coupled to an output terminal of the control-signal output sub-circuit;

an input terminal of the control-signal output sub-circuit is electrically coupled to a data line, and the control-signal output sub-circuit is configured to: compare a voltage received by the data line with a reference voltage; and if a value of the voltage received by the data line is equal to a value of the reference voltage, output a first control signal, otherwise output a second control signal;

the switch sub-circuit is configured to be turned off under control of the first control signal and to be turned on under control of the second control signal; and the reference voltage is a corresponding gamma voltage when the display panel is in a dark state.

For example, the control-signal output sub-circuit includes a comparison sub-circuit, an output sub-circuit, a first control-signal input terminal and a second control-signal input terminal;

the comparison sub-circuit is electrically coupled to the input terminal of the control-signal output sub-circuit, and is configured to: compare the voltage received by the data line with the reference voltage; and output the first signal to the output sub-circuit if the value of the voltage received by the data line is equal to the value of the reference voltage, otherwise output a second signal to the output sub-circuit;

a first terminal of the output sub-circuit is electrically coupled to the comparison sub-circuit, a second terminal of the output sub-circuit is electrically coupled to an output terminal of the control-signal output sub-circuit, a third terminal of the output sub-circuit is electrically coupled to the first control-signal input terminal, and a fourth terminal of the output sub-circuit is electrically coupled to the second control-signal input terminal; and the output sub-circuit is configured to: control the first control-signal input terminal to input the first control signal when the first terminal of the output sub-circuit receives the first signal, and output the first control signal by the second terminal of the output sub-circuit; and control the second control-signal input terminal to input the second control signal when the first terminal of the output sub-circuit receives the second signal, and output the second control signal by the second terminal of the output sub-circuit.

For example, the comparison sub-circuit includes a first comparator and a second comparator, and the reference voltage includes a first reference sub-voltage and a second reference sub-voltage;

the first comparator is configured to compare a positive voltage received by the data line with the first reference sub-voltage;

the second comparator is configured to compare a negative voltage received by the data line with the second reference sub-voltage;

the first reference sub-voltage is a corresponding gamma voltage having a positive polarity when the display panel is in the dark state; and the second reference sub-voltage is a corresponding gamma voltage having a negative polarity when the display panel is in the dark state.

For example, the output sub-circuit includes a first output unit and a second output unit;

a first terminal of the first output unit is electrically coupled to the comparison sub-circuit, a second terminal of the first output unit is electrically coupled to the first control-signal input terminal, and a third terminal of the first output unit is electrically coupled to the output terminal of the control-signal output sub-circuit; and a first terminal of the second output unit is electrically coupled to the comparison sub-circuit, a second terminal of the second output unit is electrically coupled to the second control-signal input terminal, and a third terminal of the second output unit is electrically coupled to the output terminal of the control-signal output sub-circuit.

For example, the first output unit and the second output unit are different types of transistors.

For example, the first output unit is an N-type transistor, and the second output unit is a P-type transistor.

For example, the first output unit is a P-type transistor, and the second output unit is an N-type transistor.

For example, the switch sub-circuit includes a first switch unit and a second switch unit;

a first terminal of the first switch unit is electrically coupled to an input terminal of the switch sub-circuit, and a second terminal of the first switch unit is electrically coupled to a gate line of the display panel; and a first terminal of the second switch unit is electrically coupled to a third terminal of the first switch unit, a second terminal of the second switch unit is electrically coupled to the data line, and a third terminal of the second switch unit is electrically coupled to a pixel electrode of the display panel.

For example, the first switch unit and the second switch unit are N-type transistors.

For example, the first switch unit is a P-type transistor, and the second switch unit is an N-type transistor.

For example, the first switch unit is configured to be turned off under control of the first control signal, and to be turned on under control of the second control signal.

For example, the first control signal is a high level signal and the second control signal is a low level signal.

For example, the first control signal is a low level signal and the second control signal is a high level signal.

Embodiments of the disclosure provide a display device, comprising a display panel, wherein the display panel includes a plurality of sub-pixel units, a plurality of data lines, and a plurality of pixel control circuits described above; and an output terminal of each of the pixel control circuits is electrically coupled to a pixel electrode of one of the sub-pixel units.

Embodiments of the disclosure provide a control method of the pixel control circuit described above, comprising:

comparing a voltage received from a data line with a reference voltage, outputting a first control signal if a value of the voltage received from the data line is equal to a value of the reference voltage, otherwise outputting a second control signal;

switching off a connection between the data line and a pixel electrode under control of the first control signal; and switching on the connection between the data line and the pixel electrode under control of the second control signal;

wherein the reference voltage is a corresponding gamma voltage when the display panel is in a dark state.

For example, comparing the voltage received from the data line with the reference voltage, outputting the first control signal if the value of the voltage received from the data line is equal to the value of the reference voltage, otherwise outputting the second control signal, includes: when the voltage received from the data line is a positive voltage, comparing the positive voltage with a first reference sub-voltage by using a first comparator, wherein the first reference sub-voltage is a corresponding gamma voltage having a positive polarity when the display panel is in the dark state; outputting the first control signal when a value of the positive voltage is equal to a value of the first reference sub-voltage; and outputting the second control signal when the value of the positive voltage is greater than the value of the first reference sub-voltage, wherein the reference voltage includes the first reference sub-voltage.

For example, the control method further comprises: when the voltage received from the data line is a negative voltage, comparing the negative voltage with a second reference sub-voltage by using a second comparator, wherein the second reference sub-voltage is a corresponding gamma voltage having a negative polarity when the display panel is in the dark state; outputting the first control signal when a value of the negative voltage is equal to a value of the second reference sub-voltage; and outputting the second control signal when the value of the negative voltage is less than the value of the second reference sub-voltage, wherein the reference voltage includes the first reference sub-voltage.

For example, when a polarity inversion control signal is a high level signal, the voltage received from the data line is the positive voltage, and the first comparator is used for comparison; and when the polarity inversion control signal is a low level signal, the voltage received from the data line is the negative voltage, and the second comparator is used for comparison.

For example, the first control signal is a high level signal and the second control signal is a low level signal.

For example, the first control signal is a low level signal and the second control signal is a high level signal.

BRIEF DESCRIPTION OF THE DRAWINGS

In order to illustrate the technical solutions in the embodiments of the present disclosure or the existing arts more clearly, the drawings needed to be used in the description of the embodiments or the existing arts will be briefly described in the following; it is obvious that the drawings described below are only related to some embodiments of the present disclosure, for one ordinary skilled person in the art, other drawings can be obtained according to these drawings without making other inventive work.

REFERENCE SIGNS

Control-signal output sub-circuit—101; comparison sub-circuit—201; first comparator—2011; second comparator—2012; output sub-circuit—202; first output unit—401; second output unit—402; switch sub-circuit—102; first switch unit—403; second switch unit—404.

DETAILED DESCRIPTION

Hereafter, the technical solutions of the embodiments of the present disclosure will be described in a clearly and fully understandable way in connection with the drawings related to the embodiments of the disclosure. It is obvious that the described embodiments are just a part but not all of the embodiments of the present disclosure. Based on embodiments of the present disclosure, all other embodiments obtained by those skilled in the art without making other inventive work should be within the scope of the present disclosure.

An embodiment of the present disclosure provides a pixel control circuit which may reduce pixel light leakage in a dark state. An embodiment of the present disclosure further provides a display device, which may reduce the pixel light leakage in the dark state and improve image quality. An embodiment of the present disclosure further provides a control method using the pixel control circuit described above, which may solve a problem of pixel light leakage in a dark state of a display panel controlled by the pixel control circuit.

The embodiments of the present disclosure have, but are not limited to, the following advantageous effects:

When a pixel of a display panel emits light under control of the pixel control circuit provided by an embodiment of the present disclosure, the pixel of the display panel may not receive a data signal, so that the pixel may not leak light. Moreover, since a reference voltage is a corresponding gamma voltage when the display panel is in a dark state, the display panel of an embodiment of the present disclosure may reduce the pixel light leakage in the dark state, so as to improve the image quality of the display panel.

In addition, in the embodiments of the present disclosure, if a value of a voltage received by a data line is not equal to a value of a reference voltage (i.e., when the display panel is not in a dark state), the control-signal output sub-circuit outputs a second control signal, and the switch sub-circuit is configured to be turned on under control of the second control signal. Since the switch sub-circuit is turned on in this case, the pixel of the display panel may normally receive the data signal, so that normal display of the display panel may not be affected.

Figure 1:
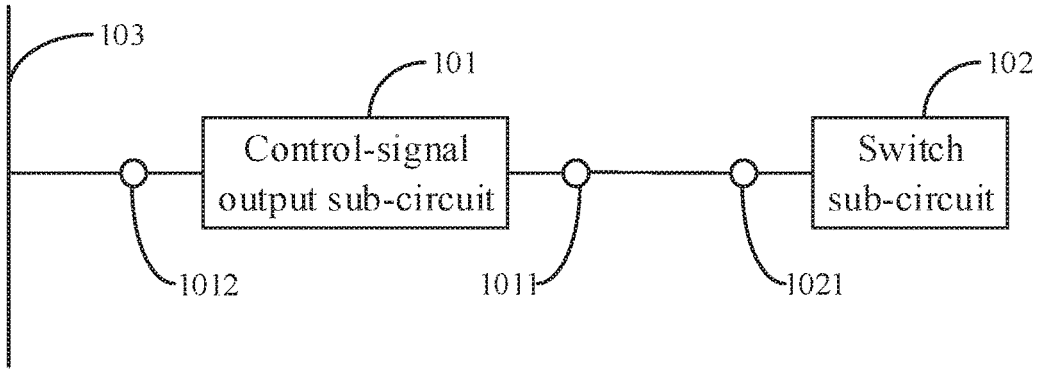
FIG. 1 is a structural schematic diagram of a pixel control circuit according to an embodiment of the present disclosure.

As shown in FIG. 1, an embodiment of the present disclosure provides a pixel control circuit, comprising: a control-signal output sub-circuit 101 and a switch sub-circuit 102. An input terminal 1021 of the switch sub-circuit 102 is electrically coupled to an output terminal 1011 of the control-signal output sub-circuit 101. An input terminal 1012 of the control-signal output sub-circuit 101 is electrically coupled to a data line 103. The control-signal output sub-circuit 101 is configured to: compare a voltage received by the data line 103 with a reference voltage; output a first control signal if a value of the voltage received by the data line 103 is equal to a value of the reference voltage; and output a second control signal if the value of the voltage received by the data line 103 is not equal to the value of the reference voltage. The switch sub-circuit 102 is configured to be turned off under control of the first control signal and to be turned on under control of the second control signal.

For example, the reference voltage is a corresponding gamma voltage when the display panel is in a dark state. For another example, the reference voltage can be predetermined in advance. Alternatively, the reference voltage can be determined in near real time or in any time according to actual needs.

The pixel control circuit provided by an embodiment of the present disclosure comprises a control-signal output sub-circuit and a switch sub-circuit; an input terminal of the control-signal output sub-circuit is electrically coupled to a data line; the control-signal output sub-circuit is configured to compare a voltage received by the data line with a reference voltage, and output a first control signal if a value of the voltage received by the data line is equal to a value of the reference voltage; and the switch sub-circuit is configured to be turned off under control of the first control signal. Since the switch sub-circuit is turned off, when a pixel of the display panel emits light under control of the pixel control circuit provided by an embodiment of the present disclosure, the pixel of the display panel may not receive a signal inputted through the data line, and the pixel may not leak light. Because the reference voltage is a corresponding gamma voltage when the display panel is in a dark state, the display panel may reduce pixel light leakage in the dark state, so as to improve the image quality of the display panel.

In addition, if a value of the voltage received by the data line is not equal to a value of the reference voltage, that is, when the display panel is in a non-dark state, the control-signal output sub-circuit outputs a second control signal, and the switch sub-circuit is configured to be turned on under control of the second control signal. Since the switch sub-circuit is turned on at this point, the pixel of the display panel may normally receive a signal inputted through the data line, and normal display of the display panel may not be affected at this point.

A specific working process of controlling a pixel of the display panel to emit light by using the pixel control circuit provided by an embodiment of the present disclosure will be described in detail in the following.

Figure 2:
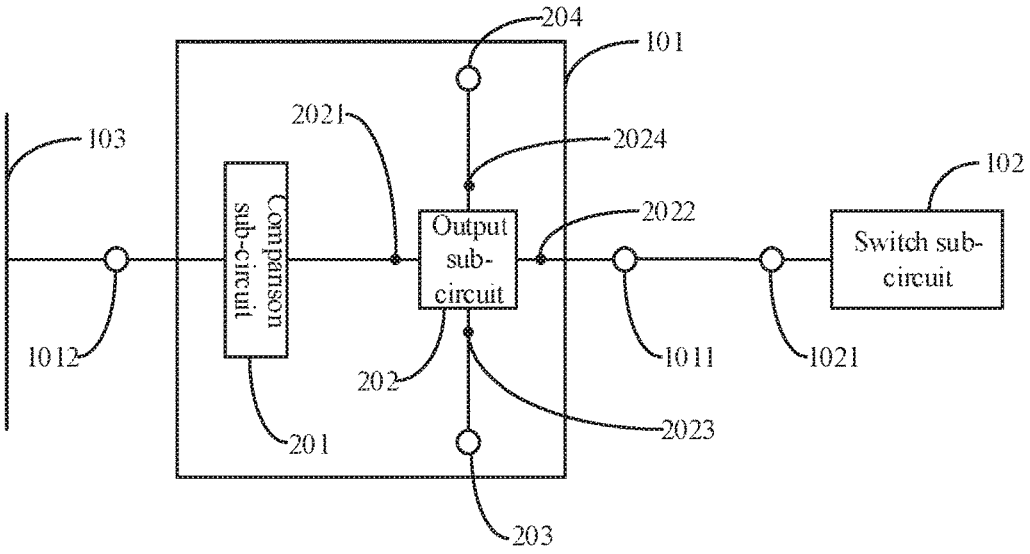
FIG. 2 is a structural schematic diagram of a control-signal output sub-circuit in a pixel control circuit provided by an embodiment of the present disclosure.

For example, as shown in FIG. 2, the control-signal output sub-circuit 101 in a specific embodiment of the present disclosure includes a comparison sub-circuit 201, an output sub-circuit 202, a first control-signal input terminal 203 and a second control-signal input terminal 204.

The comparison sub-circuit 201 is electrically coupled to the input terminal 1012 of the control-signal output sub-circuit. The comparison sub-circuit 201 is configured to compare a voltage received by the data line with a reference voltage, output a first signal to the output sub-circuit 202 if a value of the voltage received by the data line is equal to a value of the reference voltage, otherwise output a second signal to the output sub-circuit 202.

A first terminal 2021 of the output sub-circuit 202 is electrically coupled to the comparison sub-circuit 201, a second terminal 2022 of the output sub-circuit 202 is electrically coupled to an output terminal 1011 of the control-signal output sub-circuit, a third terminal 2023 of the output sub-circuit 202 is electrically coupled to the first control-signal input terminal 203, and a fourth terminal 2024 of the output sub-circuit 202 is electrically coupled to the second control-signal input terminal 204.

The output sub-circuit 202 is configured to: control the first control-signal input terminal 203 to input a first control signal when the first terminal 2021 receives the first signal, and output the first control signal through the second terminal 2022; and control the second control-signal input terminal 204 to input a second control signal when the first terminal 2021 receives the second signal, and output the second control signal through the second terminal 2022.

In an embodiment of the present disclosure, a value of the voltage received by the data line is compared with a value of the reference voltage by using the comparison sub-circuit, which is more convenient and simple in actual circuit design, and the comparison result is also more accurate, and arrangement of the comparison sub-circuit may not increase complexity of the circuit.

Figure 3:
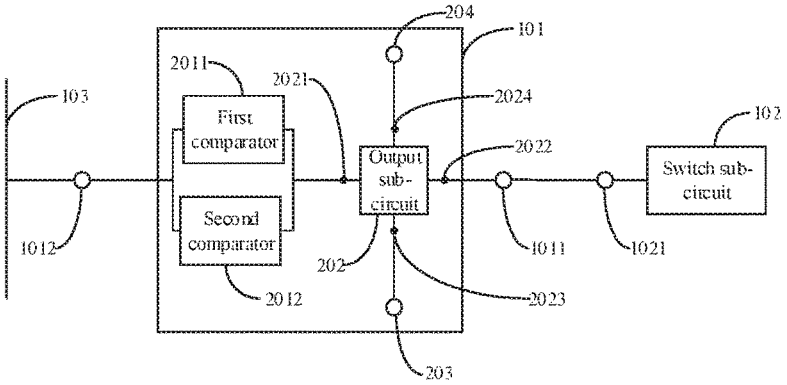
FIG. 3 shows another structural schematic diagram of a control-signal output sub-circuit in a pixel control circuit provided by an embodiment of the present disclosure.

Further, in order to reduce a computation amount of the comparison sub-circuit and improve accuracy of the comparison result of the comparison sub-circuit, as shown in FIG. 3, the comparison sub-circuit in an embodiment of the present disclosure includes a first comparator 2011 and a second comparator 2012.

The first comparator 2011 is configured to compare a positive voltage received by the data line 103 with a first reference sub-voltage; and the second comparator 2012 is configured to compare a negative voltage received by the data line 103 with a second reference sub-voltage.

For example, the reference voltage includes a first reference sub-voltage and a second reference sub-voltage. The first reference sub-voltage is a corresponding gamma voltage having a positive polarity when the display panel is in a dark state. In a specific implementation, a difference between the first reference sub-voltage and a common voltage inputted into the display panel is positive. The second reference sub-voltage is a corresponding gamma voltage having a negative polarity when the display panel is in the dark state. In a specific implementation, a difference between the second reference sub-voltage and a common voltage inputted into the display panel is negative.

In an embodiment of the present disclosure, voltages having different polarities received from the data line are compared by different comparators. If the received voltage is a positive voltage, the first comparator is used for comparison; if the received voltage is a negative voltage, the second comparator is used for comparison. In this way, a comparison result of the comparator may be more accurate, and the comparison result may be obtained more quickly, and a calculation cost of the comparator may be reduced. In a specific implementation, a control chip for controlling polarity changes may be arranged, and the first comparator or the second comparator may be selected for comparing under control of the control chip.

Figure 4:
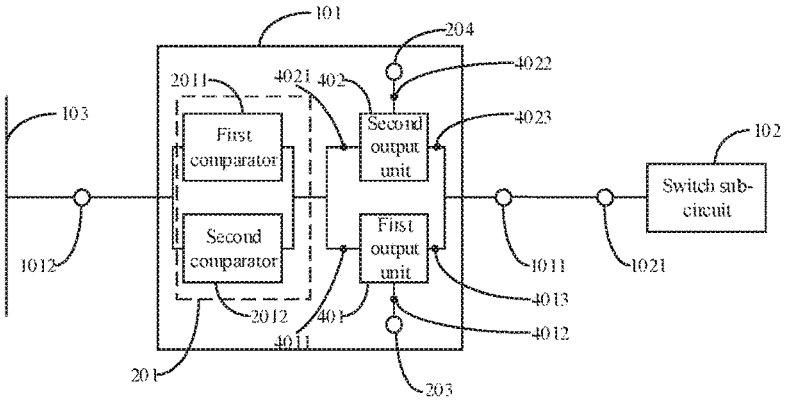
FIG. 4 is a structural schematic diagram of an output sub-circuit in a control-signal output sub-circuit in a pixel control circuit provided by an embodiment of the present disclosure.

For example, as shown in FIG. 4, the output sub-circuit 202 in a specific embodiment of the present disclosure includes a first output unit 401 and a second output unit 402. Two output units are used as the output sub-circuit, which is more simple and convenient in actual circuit design.

A first terminal 4011 of the first output unit 401 is electrically coupled to the comparison sub-circuit 201, a second terminal 4012 of the first output unit 401 is electrically coupled to the first control-signal input terminal 203, and a third terminal 4013 of the first output unit 401 is electrically coupled to the output terminal 1011 of the control-signal output sub-circuit.

A first terminal 4021 of the second output unit 402 is electrically coupled to the comparison sub-circuit 201, a second terminal 4022 of the second output unit 402 is electrically coupled to the second control-signal input terminal 204, and a third terminal 4023 of the second output unit 402 is electrically coupled to the output terminal 1011 of the control-signal output sub-circuit.

Figure 5A:
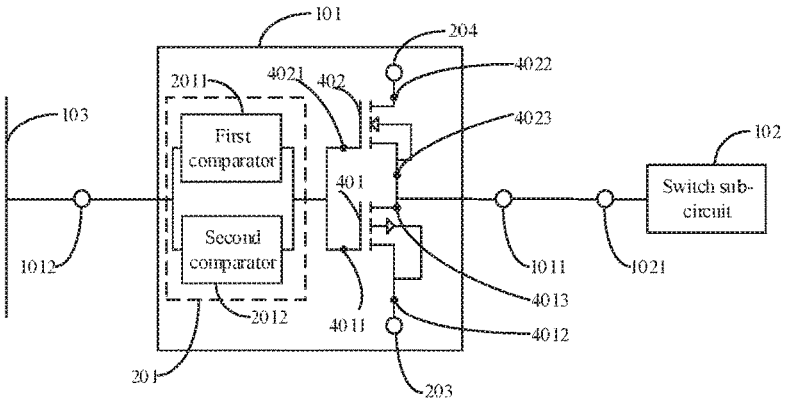
FIG. 5*a* and FIG. 5*b* are structural schematic circuit diagrams of a control-signal output sub-circuit in a pixel control circuit provided by an embodiment of the present disclosure.
Figure 5B:
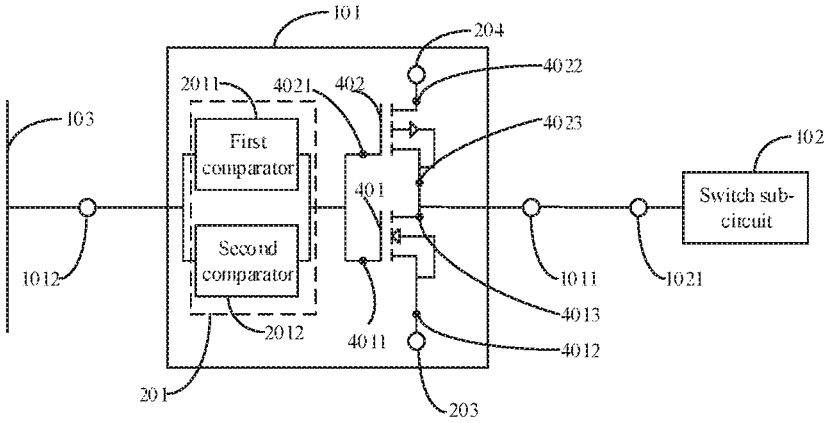

For example, as shown in FIG. 5*a*, the first output unit 401 in an embodiment of the present disclosure is an N-type transistor, and the second output unit 402 is a P-type transistor. For example, the first output unit 401 is an N-type Metal Oxide Semiconductor (NMOS) transistor, and the second output unit 402 is a P-type Metal Oxide Semiconductor (PMOS) transistor. Alternatively, as shown in FIG. 5*b*, the first output unit 401 in an embodiment of the present disclosure is a P-type transistor, and the second output unit 402 is an N-type thin film transistor; for example, the first output unit 401 is a P-type Metal Oxide Semiconductor (PMOS) transistor, and the second output unit 402 is an N-type Metal Oxide Semiconductor (NMOS) transistor. That is, the first output unit 401 and the second output unit 402 are different types of transistors.

Figure 6A:
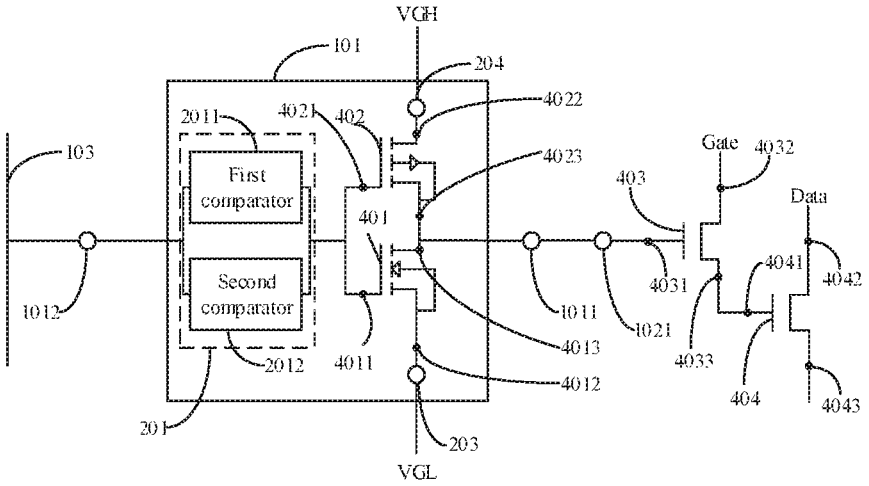
FIG. 6*a* and FIG. 6*b* are structural schematic circuit diagrams of a switch sub-circuit in a pixel control circuit provided by an embodiment of the present disclosure.
Figure 6B:
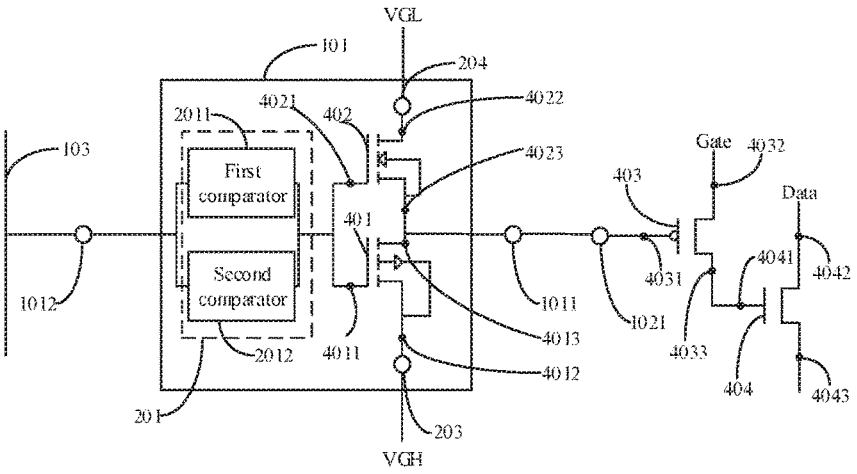

For example, as shown in FIGS. 6*a* and 6*b*, the switch sub-circuit 102 in an embodiment of the present disclosure includes a first switch unit 403 and a second switch unit 404.

A first terminal 4031 of the first switch unit 403 is electrically coupled to the input terminal 1021 of the switch sub-circuit 102, and a second terminal 4023 of the first switch unit 403 is electrically coupled to a gate line of the display panel (the figure only shows a gate signal Gate output by a gate line);

A first terminal 4041 of the second switch unit 404 is electrically coupled to a third terminal 4033 of the first switch unit 403, a second terminal 4042 of the second switch unit 404 is electrically coupled to the data line (the figure only shows a data signal Data output by the data line), and a third terminal 4043 of the second switch unit 404 is electrically coupled to a pixel electrode of the display panel (a specific arrangement for the pixel electrode is same as that in the prior art, which is not shown in the figure).

For example, as shown in FIG. 6*a*, the first switch unit 403 in an embodiment of the present disclosure is an N-type transistor, and the second switch unit 404 is an N-type transistor. For example, the first switch unit 403 is an N-type Thin Film Transistor (TFT), and the second switch unit 404 is an N-type Thin Film Transistor (TFT); or, as shown in FIG. 6*b*, the first switch unit 403 in an embodiment of the present disclosure is a P-type transistor and the second switch unit 404 is an N-type transistor. For example, the first switch unit 403 is a P-type Thin Film Transistor (TFT), and the second switch unit 404 is an N-type Thin Film Transistor (TFT).

As shown in FIG. 6*a*, the first switch unit 403 in an embodiment of the present disclosure is configured to be turned off under control of the first control signal, and to be turned on under control of the second control signal. For example, the first control signal is a low level signal (VGL) and the second control signal is a high level signal (VGH).

As shown in FIG. 6*b*, the first switch unit 403 in an embodiment of the present disclosure is configured to be turned off under control of the first control signal, and to be turned on under control of the second control signal. For example, the first control signal is a high level signal (VGH) and the second control signal is a low level signal (VGL).

An embodiment of the present disclosure further provides a display device, comprising a display panel, and the display panel includes a plurality of sub-pixel units and a plurality of data lines. In an embodiment of the present disclosure, division of the sub-pixel units and a specific arrangement of the data lines are same as those in the prior art, which will not be repeated here.

The display device provided by an embodiment of the present disclosure further includes a plurality of pixel control circuits, wherein an output terminal of each pixel control circuit is electrically coupled to a pixel electrode included in one sub-pixel unit. For example, as shown in FIGS. 6*a* and 6*b*, the third terminal 4043 of the second switch unit 404 is electrically coupled to the pixel electrode.

Hereinafter, a reason why the display device provided by an embodiment of the present disclosure may reduce the pixel light leakage may be described in detail in conjunction with FIG. 6*a* and FIG. 6*b*.

In a specific implementation, the control-signal output sub-circuit of the pixel control circuit provided by an embodiment of the present disclosure may be arranged in a driving integrated chip of a display device, and the switch sub-circuit of the pixel control circuit may be arranged on a display panel of the display device.

As shown in FIGS. 6*a* and 6*b*, an embodiment of the present disclosure provides two comparators including a first comparator and a second comparator. In a specific implementation, an embodiment of the present disclosure may control selection of the comparators through a polarity inversion control signal (POL) on a driving integrated chip arranged in the display device. When the POL is a high level signal, a value of a voltage signal received by the data line is positive, and at this time, the first comparator 2011 is used for comparison; when the POL is a low level signal, the value of the voltage signal received by the data line is negative, and at this time, the second comparator 2012 is used for comparison.

In the following, two specific examples are used for description.

Example I

As shown in FIG. 6*a*, when a value of a voltage signal received by the data line is positive, the first comparator 2011 is used for comparing the positive voltage received by the data line with a first reference sub-voltage, and the first reference sub-voltage is a corresponding gamma voltage having a positive polarity when the display panel is in a dark state.

As shown in FIG. 6*a*, when a value of the positive voltage received by the data line is equal to a value of the first reference sub-voltage, the first comparator 2011 outputs a low level VGL. At this time, a first output unit 401 is turned on, the first control-signal input terminal 203 inputs a VGL, the VGL may be applied to a first terminal 4031 of the first switch unit 403, and the first switch unit 403 is turned off. Even if the Gate is a high level signal at this time, since the first switch unit 403 is turned off, the second switch unit 404 is turned off. A third terminal 4043 of the second switch unit 404 is electrically coupled to the pixel electrode, and a pixel corresponding to the second switch unit 404 may not receive the Data signal, so that the pixel light leakage may be reduced.

As shown in FIG. 6*a*, when a value of the positive voltage received by the data line is greater than a value of the first reference sub-voltage, the first comparator 2011 outputs a high level VGH. At this time, the second output unit 402 is turned on, the second control-signal input terminal 204 inputs a VGH, and the VGH may be applied to a first terminal 4031 of the first switch unit 403, and the first switch unit 403 is turned on. When the Gate is a high level signal, the second switch unit 404 may be turned on, and at this time, a pixel corresponding to the second switch unit 404 may receive the Data signal, so that normal display may be performed.

As shown in FIG. 6*a*, when a value of the voltage signal received by the data line is negative, the second comparator 2012 is used for comparing the negative voltage received by the data line with the second reference sub-voltage, and the second reference sub-voltage is a corresponding gamma voltage having a negative polarity when the display panel is in a dark state.

As shown in FIG. 6*a*, when a value of the negative voltage received by the data line is equal to a value of the second reference sub-voltage, the second comparator 2012 outputs a low level VGL. At this time, a first output unit 401 is turned on, a VGL input by the first control-signal input terminal 203 may be applied to a first terminal 4031 of the first switch unit 403, and the first switch unit 403 is turned off. At this time, a pixel corresponding to the second switch unit 404 may not receive the Data signal, so that the pixel light leakage may be reduced.

As shown in FIG. 6*a*, when a value of the negative voltage received by the data line is less than a value of the first reference sub-voltage, a high level VGH is output. At this time, the second output unit 402 is turned on, a VGH input by the second control-signal input terminal 204 may be applied to a first terminal 4031 of the first switch unit 403, and the first switch unit 403 is turned on. When the Gate is a high level signal, the second switch unit 404 may be turned on, and at this time, a pixel corresponding to the second switch unit 404 may receive the Data signal, so that normal display may be performed.

In a specific implementation, for a display device of 6-bit output, a gamma voltage is from V1 to V14. For a display device of an Advanced Super Dimension Switch (ADS) type, V7 and V8 correspond to voltages in a dark state (LO), and a difference between V7 and a common voltage is positive, and a difference between V8 and a common voltage is negative. Therefore, in an embodiment of the present disclosure, the first reference sub-voltage may be set to V7 and the second reference sub-voltage may be set to V8. Of course, the first reference sub-voltage may be set to another voltage value higher than V7 and the second reference voltage may be set to another voltage values lower than V8 according to actual production needs in an actual production process.

For a display device of a Twisted Nematic (TN) type, V1 and V14 correspond to voltages in a dark state (LO), a difference between V1 and a common voltage is positive, and a difference between V14 and a common voltage is negative. Therefore, in an embodiment of the present disclosure, the first reference sub-voltage may be set to V1 and the second reference sub-voltage may be set to V14. Of course, the first reference sub-voltage may be set to another voltage value higher than V1 and the second reference voltage may be set to another voltage values lower than V14 according to actual production needs in an actual production process.

Example II

As shown in FIG. 6*b*, when a value of a voltage signal received by the data line is positive, the first comparator 2011 is used for comparing the positive voltage received by the data line to a first reference sub-voltage, and the first reference sub-voltage is a corresponding gamma voltage having a positive polarity when the display panel is in a dark state.

As shown in FIG. 6*b*, when a value of the positive voltage received by the data line is equal to a value of the first reference sub-voltage, a high level VGH is output. At this time, a first output unit 401 is turned on, a VGH input by the first control-signal input terminal 203 may be applied to a first terminal 4031 of the first switch unit 403, and the first switch unit 403 is turned off. Even if the Gate is a high level signal at this time, since the first switch unit 403 is turned off, the second switch unit 404 is turned off, a pixel corresponding to the second switch unit 404 may not receive the Data signal, so that the pixel light leakage may be reduced.

As shown in FIG. 6*b*, when the value of the positive voltage received by the data line is greater than the value of the first reference sub-voltage, a low level VGL is output. At this time, the second output unit 402 is turned on, a VGL input by the second control-signal input terminal 204 is applied to a first terminal 4031 of the first switch unit 403, and the first switch unit 403 is turned on. When the Gate is a high level signal, the second switch unit 404 may be turned on, and at this time, a pixel corresponding to the second switch unit 404 may receive the Data signal, so that normal display may be performed.

As shown in FIG. 6*b*, when the value of the voltage signal received by the data line is negative, the second comparator 2012 is used for comparing the negative voltage received by the data line with the second reference sub-voltage, and the second reference sub-voltage is a corresponding gamma voltage having a negative polarity when the display panel is in a dark state.

As shown in FIG. 6*b*, when a value of the negative voltage received by the data line is equal to a value of the second reference sub-voltage, a high level VGH is output. At this time, a first output unit 401 is turned on, a VGH input by the first control-signal input terminal 203 may be applied to a first terminal 4031 of the first switch unit 403, and the first switch unit 403 is turned off. At this time, a pixel corresponding to the second switch unit 404 may not receive the Data signal, so that the pixel light leakage may be reduced.

As shown in FIG. 6*b*, when the value of the negative voltage received by the data line is less than the value of the second reference sub-voltage, a low level VGL is output. At this time, the second output unit 402 is turned on, a VGL input by the second control-signal input terminal 204 may be applied to a first terminal 4031 of the first switch unit 403, and the first switch unit 403 is turned on. When the Gate is a high level signal, the second switch unit 404 may be turned on, and at this time, a pixel corresponding to the second switch unit 404 may receive the Data signal, so that normal display may be performed.

In a specific implementation of Example II, specific setting methods of the first reference sub-voltage and the second reference sub-voltage are same as those in Example I, which will not be repeated here.

Figure 7:
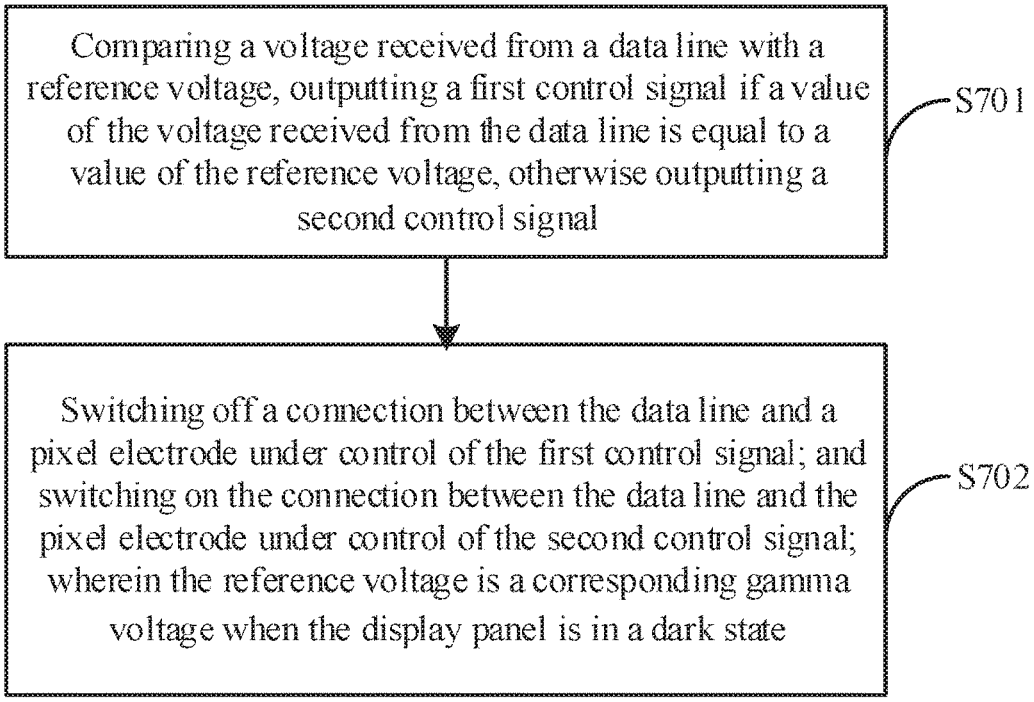
FIG. 7 is a flowchart of a control method of a pixel control circuit provided by an embodiment of the present disclosure.

As shown in FIG. 7, an embodiment of the present disclosure further provides a control method of the pixel control circuit described above, comprising:

S701: comparing a voltage received from a data line with a reference voltage, outputting a first control signal if a value of the voltage received from the data line is equal to a value of the reference voltage, otherwise outputting a second control signal; and S702: switching off a connection between the data line Data and a pixel electrode under control of the first control signal; and switching on the connection between the data line Data and the pixel electrode under control of the second control signal; wherein the reference voltage is a corresponding gamma voltage when the display panel is in a dark state.

For example, comparing the voltage received from the data line with the reference voltage, outputting the first control signal if the value of the voltage received from the data line is equal to the value of the reference voltage, otherwise outputting the second control signal, includes:

When the voltage received from the data line is a positive voltage, comparing the positive voltage with a first reference sub-voltage by using a first comparator, wherein the first reference sub-voltage is a corresponding gamma voltage having a positive polarity when the display panel is in a dark state;

Outputting the first control signal when a value of the positive voltage is equal to a value of the first reference sub-voltage; and Outputting the second control signal when the value of the positive voltage is greater than the value of the first reference sub-voltage, wherein the reference voltage includes the first reference sub-voltage.

For example, comparing the voltage received from the data line with the reference voltage, outputting the first control signal if the value of the voltage received from the data line is equal to the value of the reference voltage, otherwise outputting the second control signal, includes:

When the voltage received from the data line is a negative voltage, comparing the negative voltage with a second reference sub-voltage by using a second comparator, wherein the second reference sub-voltage is a corresponding gamma voltage having a negative polarity when the display panel is in the dark state;

Outputting the first control signal when a value of the negative voltage is equal to a value of the second reference sub-voltage; and Outputting the second control signal when the value of the negative voltage is less than the value of the second reference sub-voltage, wherein the reference voltage includes the second reference sub-voltage.

For example, when a polarity inversion control signal is a high level signal, the voltage received from the data line is a positive voltage, and the first comparator is used for comparing; and when the polarity inversion control signal is a low level signal, the voltage received from the data line is a negative voltage, and the second comparator is used for comparison.

For example, the first control signal is a high level signal and the second control signal is a low level signal. Or, the first control signal is a low level signal and the second control signal is a high level signal.

A specific control method of the pixel control circuit in an embodiment of the present disclosure has been described by Example I and Example II, which will not be repeated here.

In conclusion, an embodiment of the present disclosure helps a gate signal Gate to control the switch sub-circuit to be turned on and turned off through the pixel control circuit (the switch sub-circuit is electrically coupled to the pixel electrode), so that the pixel is turned off in the dark state of the display panel, and in this way, there will be no current leakage, which may reduce the light leakage in the dark state and improve the image quality of the display panel.

The foregoing descriptions are merely part of the embodiments of the present disclosure, and it should be pointed out that, for those skilled in the art, various modifications and improvements can be made without departing from the principle of the present disclosure, and these modifications and improvements should be regarded as falling in the scope of the present disclosure.

The invention claimed is:

1. A pixel control circuit, comprising: a control-signal output sub-circuit and a switch sub-circuit; wherein:

an input terminal of the switch sub-circuit is electrically coupled to an output terminal of the control-signal output sub-circuit;

an input terminal of the control-signal output sub-circuit is electrically coupled to a data line, and the control-signal output sub-circuit is configured to: compare a voltage received by the data line with a reference voltage; and if a value of the voltage received by the data line is equal to a value of the reference voltage, output a first control signal, otherwise output a second control signal;

the switch sub-circuit is configured to be turned off under control of the first control signal and to be turned on under control of the second control signal; and the reference voltage is a corresponding gamma voltage when the display panel is in a dark state.

2. The pixel control circuit according to claim 1, wherein the control-signal output sub-circuit includes a comparison sub-circuit, an output sub-circuit, a first control-signal input terminal and a second control-signal input terminal;

the comparison sub-circuit is electrically coupled to the input terminal of the control-signal output sub-circuit, and is configured to: compare the voltage received by the data line with the reference voltage; and output the first signal to the output sub-circuit if the value of the voltage received by the data line is equal to the value of the reference voltage, otherwise output a second signal to the output sub-circuit;

a first terminal of the output sub-circuit is electrically coupled to the comparison sub-circuit, a second terminal of the output sub-circuit is electrically coupled to an output terminal of the control-signal output sub-circuit, a third terminal of the output sub-circuit is electrically coupled to the first control-signal input terminal, and a fourth terminal of the output sub-circuit is electrically coupled to the second control-signal input terminal; and the output sub-circuit is configured to: control the first control-signal input terminal to input the first control signal when the first terminal of the output sub-circuit receives the first signal, and output the first control signal by the second terminal of the output sub-circuit; and control the second control-signal input terminal to input the second control signal when the first terminal of the output sub-circuit receives the second signal, and output the second control signal by the second terminal of the output sub-circuit.

3. The pixel control circuit according to claim 2, wherein the comparison sub-circuit includes a first comparator and a second comparator, and the reference voltage includes a first reference sub-voltage and a second reference sub-voltage;

the first comparator is configured to compare a positive voltage received by the data line with the first reference sub-voltage;

the second comparator is configured to compare a negative voltage received by the data line with the second reference sub-voltage;

the first reference sub-voltage is a corresponding gamma voltage having a positive polarity when the display panel is in the dark state; and the second reference sub-voltage is a corresponding gamma voltage having a negative polarity when the display panel is in the dark state.

4. The pixel control circuit according to claim 2, wherein the output sub-circuit includes a first output unit and a second output unit;

a first terminal of the first output unit is electrically coupled to the comparison sub-circuit, a second terminal of the first output unit is electrically coupled to the first control-signal input terminal, and a third terminal of the first output unit is electrically coupled to the output terminal of the control-signal output sub-circuit; and a first terminal of the second output unit is electrically coupled to the comparison sub-circuit, a second terminal of the second output unit is electrically coupled to the second control-signal input terminal, and a third terminal of the second output unit is electrically coupled to the output terminal of the control-signal output sub-circuit.

5. The pixel control circuit according to claim 4, wherein the first output unit and the second output unit are different types of transistors.

6. The pixel control circuit according to claim 5, wherein the first output unit is an N-type transistor, and the second output unit is a P-type transistor.

7. The pixel control circuit according to claim 5, wherein the first output unit is a P-type transistor, and the second output unit is an N-type transistor.

8. The pixel control circuit according to claim 1, wherein the switch sub-circuit includes a first switch unit and a second switch unit;

a first terminal of the first switch unit is electrically coupled to an input terminal of the switch sub-circuit, and a second terminal of the first switch unit is electrically coupled to a gate line of the display panel; and a first terminal of the second switch unit is electrically coupled to a third terminal of the first switch unit, a second terminal of the second switch unit is electrically coupled to the data line, and a third terminal of the second switch unit is electrically coupled to a pixel electrode of the display panel.

9. The pixel control circuit according to claim 8, wherein the first switch unit and the second switch unit are N-type transistors.

10. The pixel control circuit as claimed in claim 8, wherein the first switch unit is a P-type transistor, and the second switch unit is an N-type transistor.

11. The pixel control circuit according to claim 8, wherein the first switch unit is configured to be turned off under control of the first control signal, and to be turned on under control of the second control signal.

12. The pixel control circuit according to claim 1, wherein the first control signal is a high level signal and the second control signal is a low level signal.

13. The pixel control circuit according to claim 1, wherein the first control signal is a low level signal and the second control signal is a high level signal.

14. A display device, comprising a display panel, wherein the display panel includes a plurality of sub-pixel units, a plurality of data lines, and a plurality of pixel control circuits each of which is according to claim 1; and an output terminal of each of the pixel control circuits is electrically coupled to a pixel electrode of one of the sub-pixel units.

15. A control method of the pixel control circuit according to claim 1, comprising:

comparing a voltage received from a data line with a reference voltage, outputting a first control signal if a value of the voltage received from the data line is equal to a value of the reference voltage, otherwise outputting a second control signal;

switching off a connection between the data line and a pixel electrode under control of the first control signal; and switching on the connection between the data line and the pixel electrode under control of the second control signal;

wherein the reference voltage is a corresponding gamma voltage when the display panel is in a dark state.

16. The control method according to claim 15, wherein comparing the voltage received from the data line with the reference voltage, outputting the first control signal if the value of the voltage received from the data line is equal to the value of the reference voltage, otherwise outputting the second control signal, includes:

when the voltage received from the data line is a positive voltage, comparing the positive voltage with a first reference sub-voltage by using a first comparator, wherein the first reference sub-voltage is a corresponding gamma voltage having a positive polarity when the display panel is in the dark state;

outputting the first control signal when a value of the positive voltage is equal to a value of the first reference sub-voltage; and outputting the second control signal when the value of the positive voltage is greater than the value of the first reference sub-voltage, wherein the reference voltage includes the first reference sub-voltage.

17. The control method according to claim 16, further comprising:

when the voltage received from the data line is a negative voltage, comparing the negative voltage with a second reference sub-voltage by using a second comparator, wherein the second reference sub-voltage is a corresponding gamma voltage having a negative polarity when the display panel is in the dark state;

outputting the first control signal when a value of the negative voltage is equal to a value of the second reference sub-voltage; and outputting the second control signal when the value of the negative voltage is less than the value of the second reference sub-voltage, wherein the reference voltage includes the first reference sub-voltage.

18. The control method according to claim 17, wherein when a polarity inversion control signal is a high level signal, the voltage received from the data line is the positive voltage, and the first comparator is used for comparison; and when the polarity inversion control signal is a low level signal, the voltage received from the data line is the negative voltage, and the second comparator is used for comparison.

19. The control method according to claim 16, wherein the first control signal is a high level signal and the second control signal is a low level signal.

20. The control method according to claim 16, wherein the first control signal is a low level signal and the second control signal is a high level signal.

* * * * *